US007753687B2

(12) United States Patent
Fan

(10) Patent No.: US 7,753,687 B2
(45) Date of Patent: Jul. 13, 2010

(54) PICK UP CAP FOR USE WITH SOCKET CONNECTOR HAVING PLUG COVERING OPENING

(75) Inventor: Chia-Wei Fan, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 127 days.

(21) Appl. No.: 12/231,511

(22) Filed: Sep. 2, 2008

(65) Prior Publication Data

US 2009/0061652 A1 Mar. 5, 2009

(30) Foreign Application Priority Data

Sep. 3, 2007 (CN) ..... 2007 2 0046925 U

(51) Int. Cl.
*H01R 13/44* (2006.01)

(52) U.S. Cl. ..... 439/41

(58) Field of Classification Search ..... 439/41, 439/135, 342, 940; 29/747
See application file for complete search history.

(56) References Cited

U.S. PATENT DOCUMENTS 6,877,990 B2 4/2005 Liao et al.
7,004,768 B2 2/2006 Ma et al.
7,090,517 B2 * 8/2006 Ma ..... 439/135
7,455,526 B1 * 11/2008 Ila et al. ..... 439/41
7,473,120 B2 * 1/2009 Zhang et al. ..... 439/342
7,578,684 B2 * 8/2009 Liao ..... 439/135
7,632,115 B1 * 12/2009 Polnyi ..... 439/135
7,658,627 B2 * 2/2010 Lin et al. ..... 439/135
2008/0146044 A1 * 6/2008 Liao ..... 439/41
2010/0029107 A1 * 2/2010 Yeh et al. ..... 439/135

* cited by examiner

*Primary Examiner*—Alexander Gilman
(74) *Attorney, Agent, or Firm*—Andrew C. Cheng; Wei Te Chung; Ming Chieh Chang

(57) ABSTRACT

A socket connector has a pick up cap (3) cooperated with lateral shields (4) is provided. The pick up cap (3) has a base plate (30) and a plateau (31) surrounded by the base plate (30). The main purpose of the lateral shields is used for covering seams both on a base plate (30) and under raised portions (32) on opposite sidewalls of the plateau (31). As soon as the seams are covered by the lateral shields (4), paths of particles in air possibly contaminating a plurality of contact terminals restrained in passageways of an insulative housing are able to effectively blocked. Therefore, problems either about reliability or circuit open caused by contaminated socket connector is successfully solved.

18 Claims, 7 Drawing Sheets

PICK UP CAP FOR USE WITH SOCKET CONNECTOR HAVING PLUG COVERING OPENING

BACKGROUND OF THE INVENTION

1. Field of the Invention

The present invention generally relates to a pick up cap, and more particularly to a pick up cap for use with a socket connector having lateral shields for preventing contact terminals inside the socket connector from being contaminated, for example particles in air.

2. Description of Related Art

Electronic components, such as CPU sockets, are often appropriately positioned on an underlying printed circuit board (PCB) by means of a vacuum suction device. Since the insulative housing of the CPU socket has either a plurality of through holes or a plurality of contact terminals in substantial entire surface thereof, a pick up cap is attached thereon and the vacuum suction device is manipulated on a top flat surface of the pick up cap so as to properly position the CPU socket onto the PCB. Such pick up caps are disclosed in U.S. Pat. No. 7,004,768. Refer to FIG. 1, a CPU socket connector 100, configured by insulating housing 110 having a plurality of passageways in which a plurality of contact terminals constrain, a metal stiffener 120, a lever 130 and a metal clip 140, is attached by a pick up cap 150 for being absorbed by a vacuum suction device. The pick up cap 150 has a generally rectangular planar body 152. The planar body 152 defines a smooth flat top surface 1522 and a bottom surface 1524 opposite to the top surface 1522. Two extending portions 154 extend respectively from two opposite ends of the planar body 152. One of the two extending portion 154 forms an uplift 1542, the uplift 1542 also defines top surface and a bottom surface. The uplift 1542 forms a concave 1544 that would provide a sufficient operating space for user's fingertip when the pick up cap 150 is detached from the socket connector 100.

Furthermore, U.S. Pat. No. 6,877,990 issues to Liao on Apr. 12, 2005 discloses a pick up cap 2 for use with a LGA socket connector having clasps 207' and 208' as shown in FIG. 2. While the LGA socket connector is transmitted by a vacuum suction equipment, the clasps 207' and 208' attach to lateral sidewalls of a metal clip similar with the metal clips 140 illustrated in '768. The pick up cap 2' further includes openings 202' and 203' utilized for heat dissipation during soldering the socket connector on a circuit board. Moreover, a pair of downward convex ribs 209' departing from the bottom surface of the pick up cap may contact with the upward concave metal clip for securely mounting the pick up cap 2' on the metal clip.

FIG. 3 displays another socket connector 1' without engaging with a stiffener and a metal clips comprises a pick up cap 3' attached thereon. Similar to FIG. 1, the pick up cap 3' has a plateau 30' for the absorption by a vacuum equipment to move the socket connector 1' on a printed circuit board (PCB). At the same time, both sides of the pick up cap 3' comprise holding portions 31' on sides of the plateau 30' and recesses 312' underneath the holding portions 31'. The holding portions 31' is used for being taken by a user either to attach to or to remove from the socket connector 1'. Additionally, the pick up cap 3' further comprises latches 32' on opposite edges of sidewalls thereof for engaging with an insulative housing 2' Most importantly, there are seams 314 on the surface outside of the plateau 30' due to the reason of mass production.

Unfortunately, there is a possibility that the seams 314' are likely to offer a path to make contact terminals of the socket connector 1' be contaminated by particles in air or the like. Once the contact is contaminated, it is very much likely that a reliability or open circuit issue may be raised. In the worst scenario, the whole system with contaminated socket connector will be malfunctioned. Such contaminated circumstance in a socket connector is extremely unfavorable to high-end computers systems, for example workstations or servers.

BRIEF SUMMARY OF THE INVENTION

An object, therefore, of the invention is to provide an improved socket connector of the character described and which is particularly adaptable for preventing contact terminals retained in passageways of a insulative housing from being contaminated by particles in air through the paths of seams which is both on a base plate surface of a pick up cap and under plateaus of the pick up cap surrounded by the base plate.

According to the present invention, this object may be achieved by a socket connector comprises an insulative housing having a base and perimeter walls cooperatively defining an inner cavity with a plurality of passageways in which a plurality of contact terminals are constrained, a pick up cap removably attached with the insulative housing comprising a base plate and a plateau surrounded by the base plate for being transmitted by a vacuum suction arm, the plateau further comprising a pair of raised portions extending upwardly from opposite sidewalls thereof for being held by a user to remove from or attach to the insulative housing and a pair of shield attached to the raised portions for preventing seams formed on the base plate and underneath the raised portions from insertion of particles through the seams.

In accordance with the present invention, a method of preventing contact terminals retained in passageways of an insulative housing in a socket connector from being contaminated by particles in air is provided. The steps of avoiding the contamination of the contact terminals in the socket connector before mounting a packaged integrated circuit comprise the following steps: (1) aligning guiding recesses on sides of the pick up cap with guiding posts on inner sidewalls of the insulative housing, (2) holding raised portions extending upwardly from opposite sides of the plateau and pressing down the pick up cap such that latches extending outwardly from sides of the base plate can attach to slots on outer surface of the perimeter walls of the insulative housing and (3) attaching a pair of shields to the raised portions for covering the seams.

Other objects, advantages and novel features of the invention will become more apparent from the following detailed description of the present embodiment when taken in conjunction with the accompanying drawings.

BRIEF DESCRIPTION OF THE DRAWINGS

The organization and manner of the structure and operation of the invention, together with further objects and advantages thereof, may best be understood by reference to the following description, taken in conjunction with accompanying drawings. Wherein like reference numbers identify like elements in which.

DETAILED DESCRIPTION OF THE INVENTION

The present invention will be discussed hereinafter in detail in terms of preferred embodiments of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
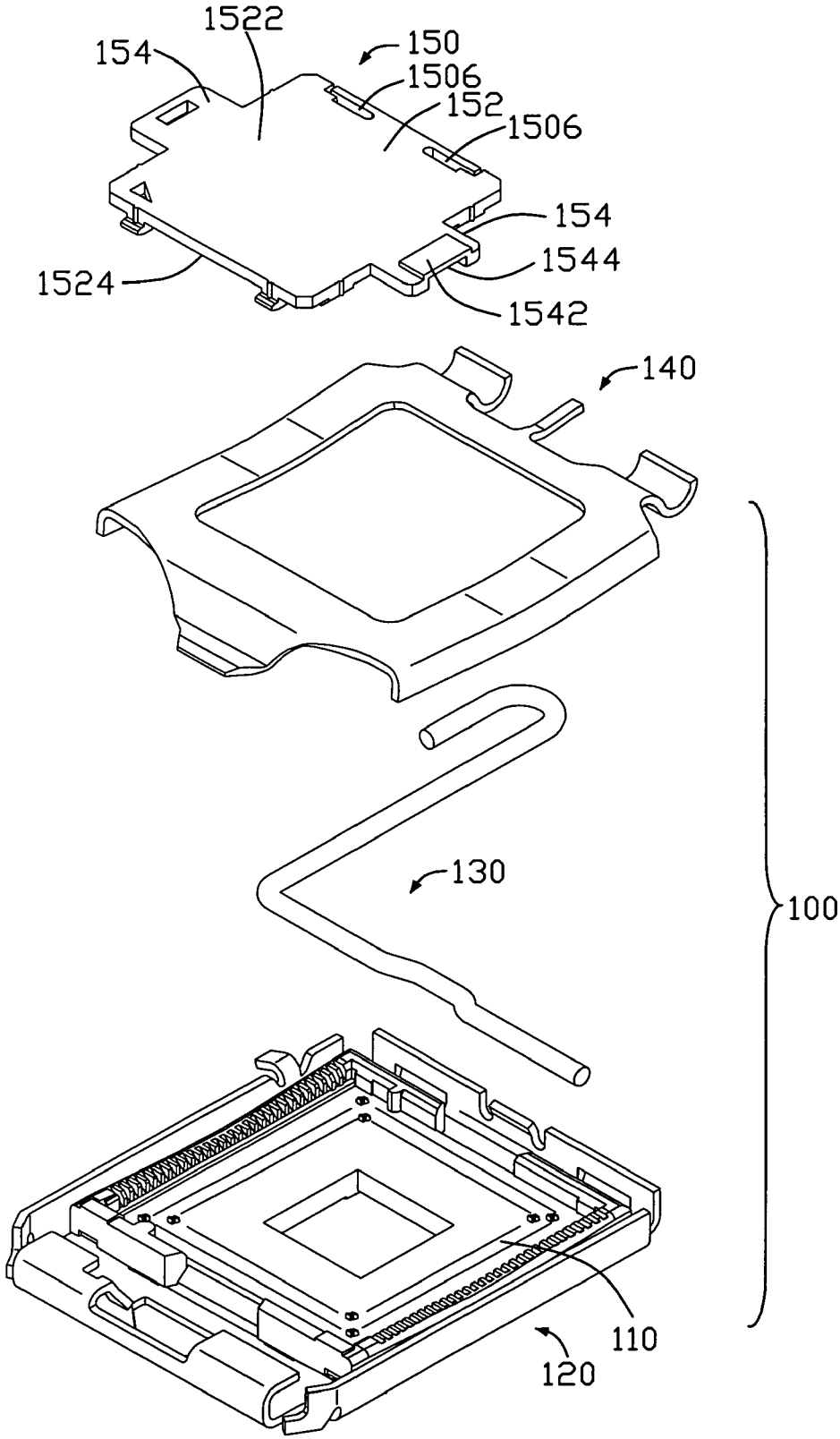
FIG. 1 illustrates an isometric exploded view of a conventional LGA socket connector with a conventional metal stiffener, metal clip and pick up cap.
Figure 2:
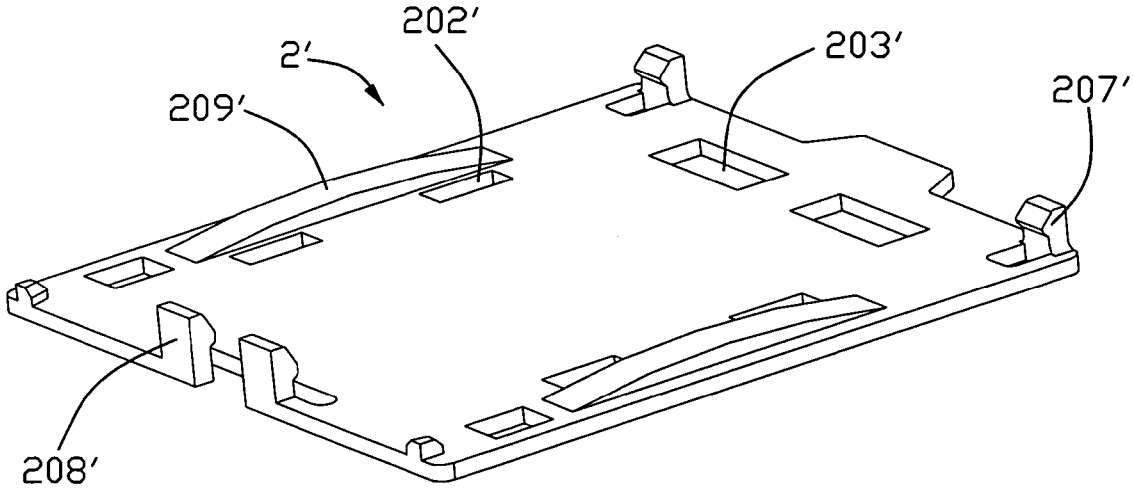
FIG. 2 illustrates a enlarged view of a conventional pick up cap for use with a socket connector.
Figure 3:
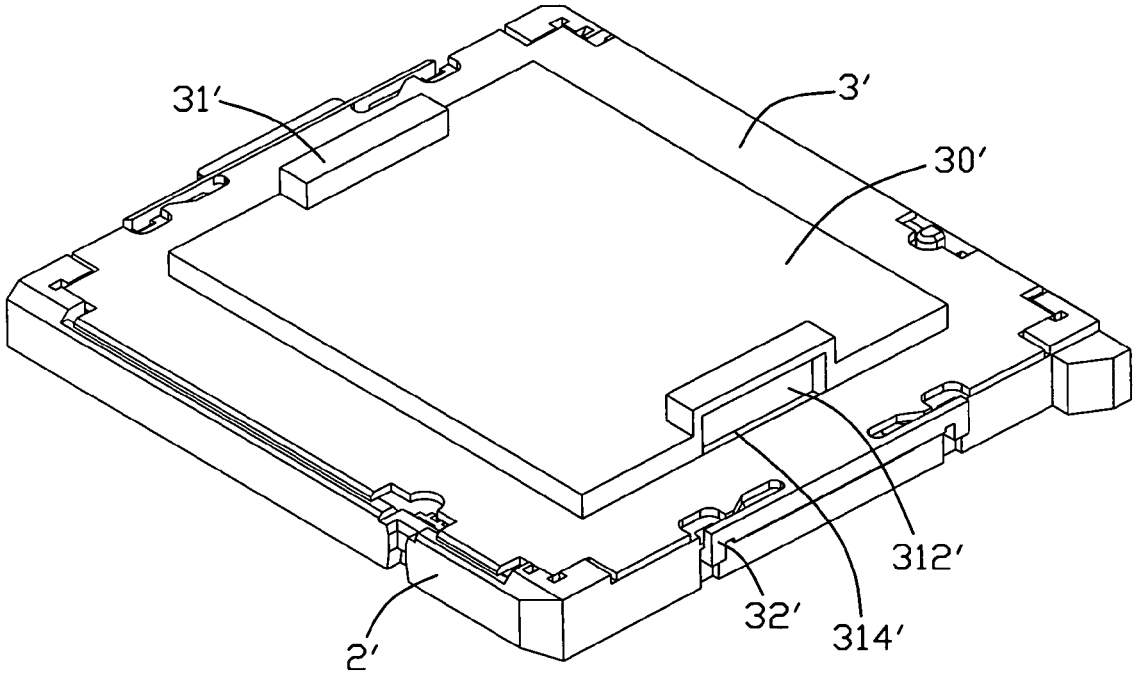
FIG. 3 illustrates an isometric view of a combination of a conventional LGA socket connector without a metal stiffener, metal clip and pick up cap.
Figure 4:
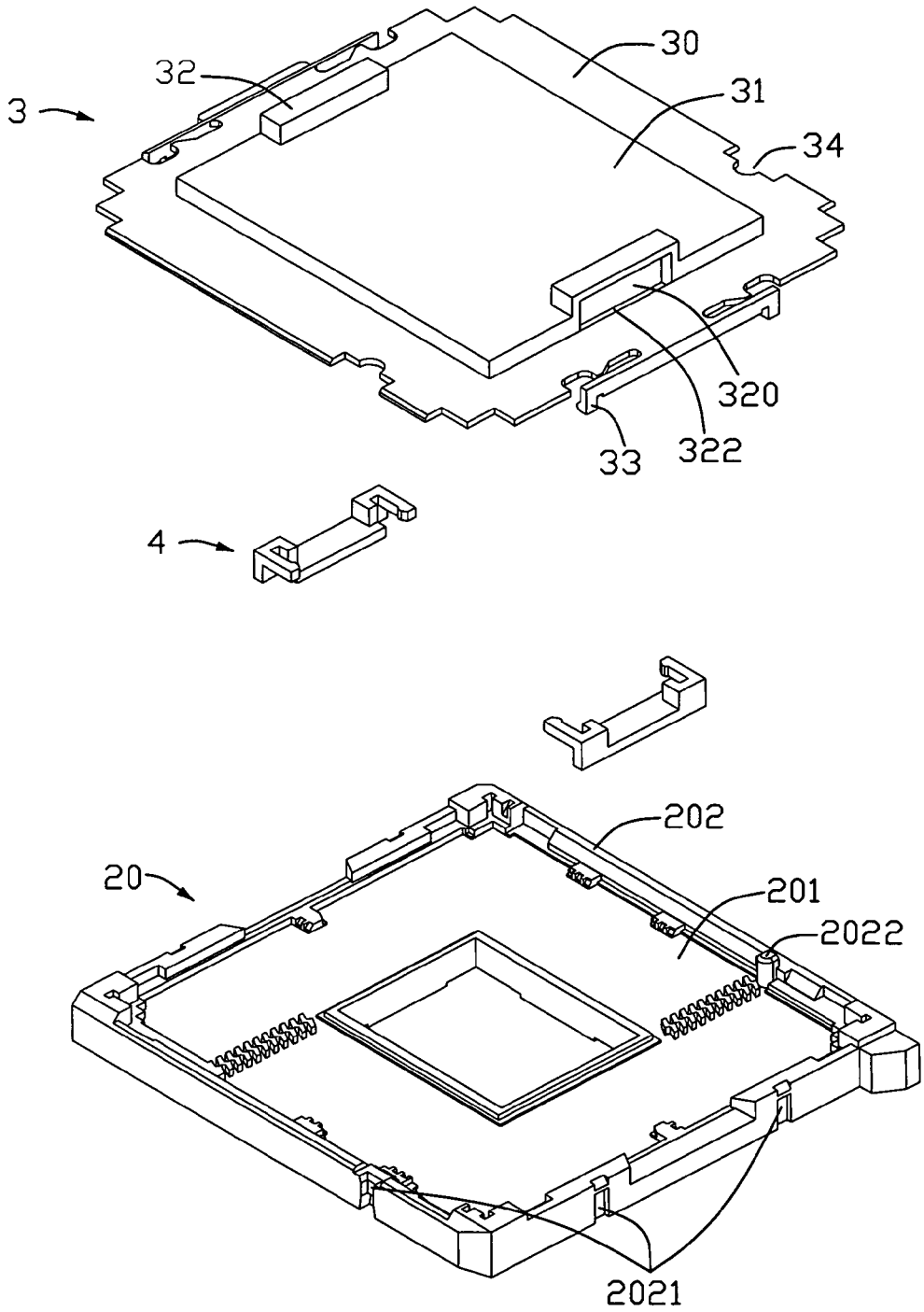
FIG. 4 illustrates an isometric exploded view of a LGA socket connector according to the preferred embodiment of the present invention.

FIG. 4 is an illustration of exploded view of a socket connector in accordance with the preferred embodiment of the present invention. The socket connector comprises an insulative housing 20 having a base 201 and perimeter sidewalls 202 to cooperatively define an inner cavity. Besides that, the socket connector further comprises a pick up cap 3 and a pair of shield 4. The pick up cap comprises a base plate 30 and a plateau 31 surrounded by the base plate 30. On sides of the base plate 30, there is at least one guiding recess 34 for aligning with corresponding guiding post 2022 located in the inner side of the perimeter sidewalls 202 while a user would like to engage the pick up cap 3 with the insulative housing 20. Furthermore, There are a plurality of latches 33 on sides of the base plate 30 for attaching with slots 2021 on outer surfaces of the perimeter sidewalls 202 and a pair of raised portions 32 extending upwardly from the opposite sidewalls of the plateau 31 adapted for being held by a user either to remove from or to attach to the insulative housing 20. The lateral outer side of the raised portions 32 respectively includes a recess 320 surrounded by the raised portions 32 for being easily held by a user to remove from or attach to the insulating housing 30. As there are a pair of seams 322 on the surface of the base plates 30 and next to the recess 320, the preferred embodiment of the invention further offer a pair of shields 4 for preventing contact terminals in the insulative housing 20 from being contaminated by particles in the air. In addition, the insulative housing 30 can be divided into a plurality of segments. Each segments has respective passageways in which a plurality of contact terminals are retained. The type of one end of the contact terminals for connecting with pads of a packaged circuit can be a zero force insertion type (ZIF) or a land grid array type (LGA). The orientation of the LGA end in adjacent segments is opposite each other.

Figure 5:
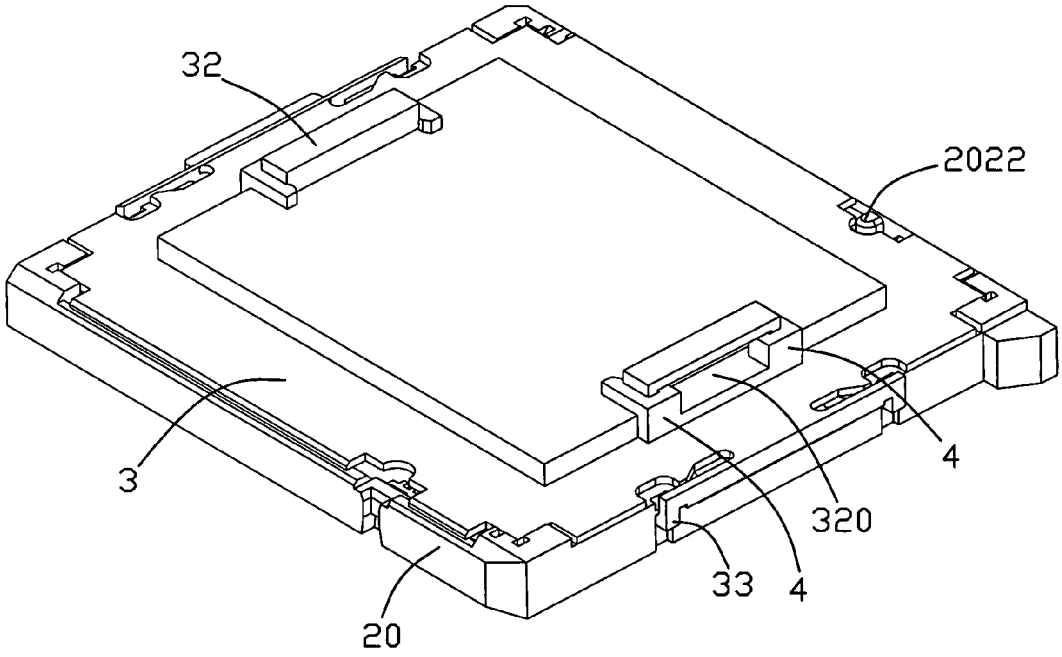
FIG. 5 illustrates an isometric view of a combination of a LGA socket connector according to the preferred embodiment of the present invention.

Referring to FIG. 5, the socket connector of the present invention displays an isometric view of a combination of the insulative housing 20 attached by the pick up cap 3 via the latches 33. At the same time, the pair of the shields 4 is laterally attached to both the plateau 31 and the raised portions 32 for cover the seams 320. Due to the protection of the shields, the contact terminals are able to effectively prevent from being contaminated by particles in the air. Therefore, The possible problems about either reliability or circuit open can be successfully overcome.

Figure 6:
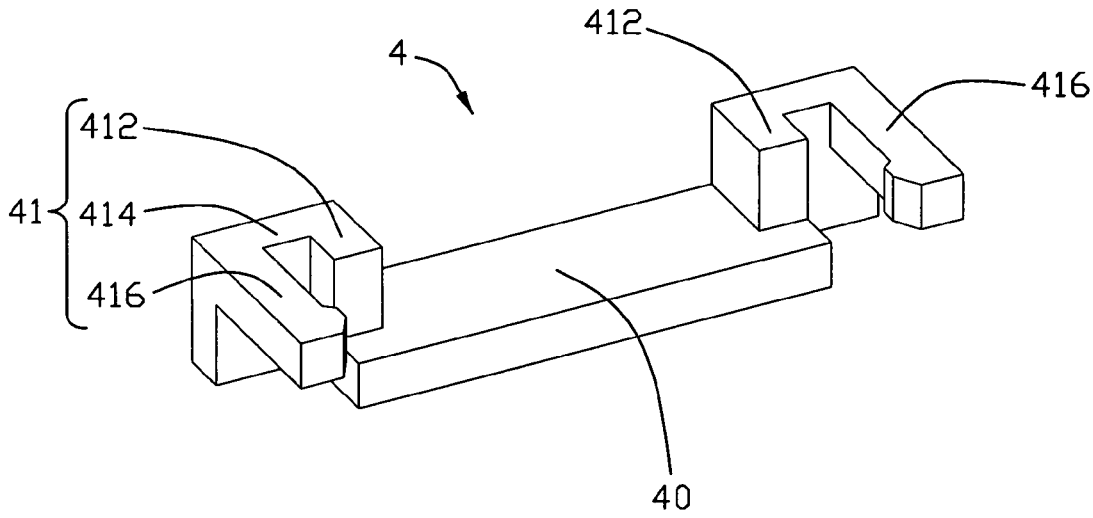
FIG. 6 illustrates an enlarged view of a shield according to the preferred embodiment of the present invention.

FIG. 6 is an illustration of an enlarged view for the shield 4 in terms of the preferred embodiment of the present invention. The shield comprises a shroud body 40 in a central area of the shield 4 and two flanges 41 on both sides of the shroud body 40. Both of the top surfaces of the flanges 41 are higher the same of the shroud body 40. Moreover, the flange 41 is classified into three parts: a stopper 412, a linker 414, and a damper 416. The pair of the dampers 416 is used for attaching to an outer backside of the raised portion 32. In the meanwhile, the pair of the stoppers 412 is against the inner sidewalls for securely mounting the shields 4 on the raised portion 32.

Figure 7:
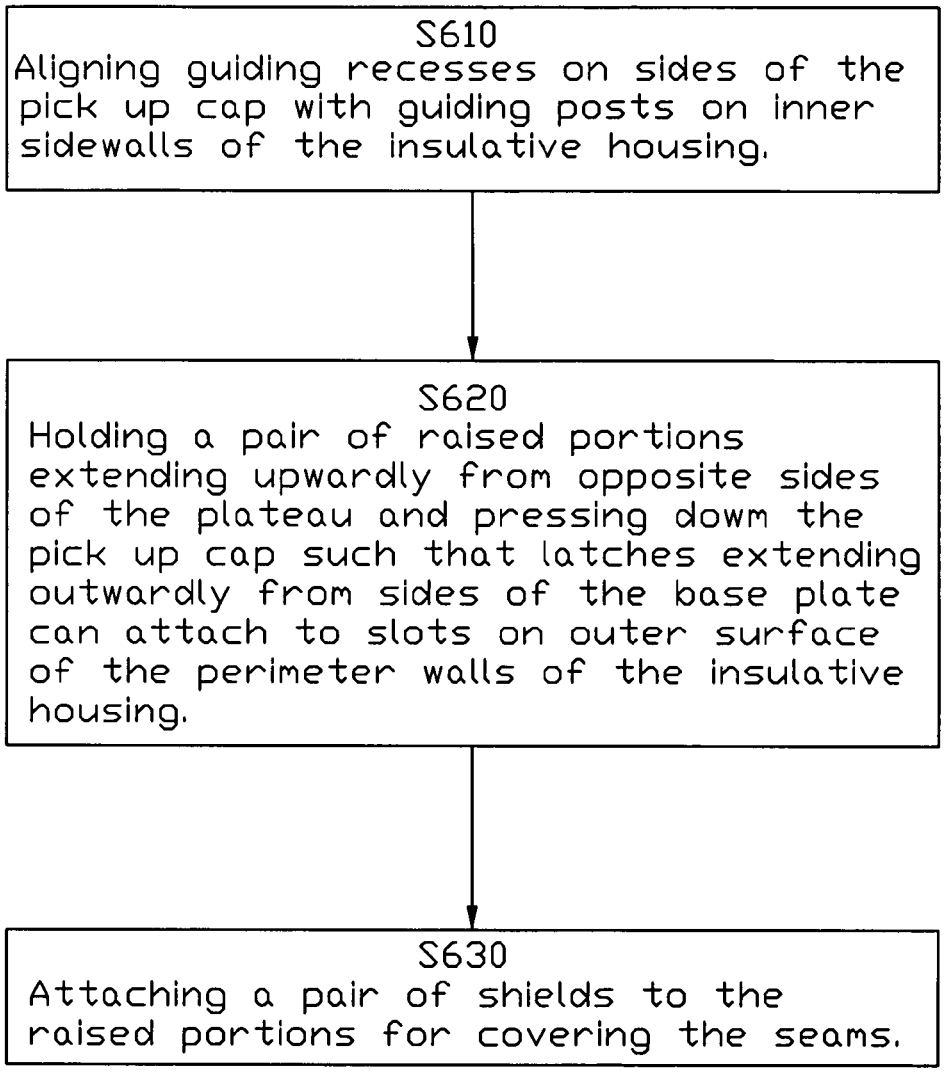
FIG. 7 illustrates a flowchart of attaching a pick up cap with preventing mechanism to an insulative housing for avoiding the insertion of particles into the insulative housing of a socket connector.

Refer to FIG. 7, steps of a flowchart of a method for preventing contact terminals retained in passageways of an insulative housing 20 of a socket connector from being contaminated by particles through seams 322 which is both on a upper surface of a base plate 30 of a pick up cap and under plateaus 31 of the pick up cap surrounded by the base plate are as followed. Firstly, aligning guiding recesses on sides of the pick up cap with guiding posts on inner sidewalls of the insulative housing shown as in S610. Afterward, holding a pair of raised portions extending upwardly from opposite sides of the plateau and pressing down the pick up cap such that latches extending outwardly from sides of the base plate can attach to slots on outer surface of the perimeter walls of the insulative housing as shown in S620. At the end, S630 show the final step to attaching a pair of shields to the raised portions for covering the seams.

Although the present invention has been illustrated and described with respect to exemplary embodiment thereof, should be understood by those skilled in the art that foregoing and various other changes, omissions and additions may be made therein and thereto, without departing from the spirit and scope of the present invention. Therefore, present invention should not be understood as limited to the specific embodiment set out above but to include all possible embodiments which can be embodied within a scope encompassed and equivalents thereof with respect to the feature set out in the appended claims.

What is claimed is:

1. An socket connector, comprising:

an insulative housing having a base and perimeter walls cooperatively defining an inner cavity with a plurality of passageways in which a plurality of contact terminals are constrained;

a pick up cap removeably attached to the insulative housing, and including a pair of handle having orifice underneath in communication with the cavity; and a pair of plugs each removeably and substantially seal the orifice.

2. The socket connector as claimed in claim 1, wherein each side of each plug having a main body for covering the orifice and a pair of positioning portions for aligning with and attaching to the raised portions.

3. The socket connector as claimed in claim 2, wherein each positioning portion is divided into stopping portion, latching portion and linking portion.

4. The socket connector as claimed in claim 1, wherein the pick up cap further comprising a base plate and a plateau surrounded by the base plate for being transmitted by a vacuum suction arm.

5. The socket connector as claimed in claim 4, wherein sides of the base plate of the pick up cap further comprising a plurality of latches for attaching to slots on outer surface of the perimeter walls of the insulative housing.

6. The socket connector as claimed in claim 4, wherein the pair of handle upward extending from sidewalls of the plateau.

7. The socket connector as claimed in claim 1, wherein the sides of the base plate of the pick up cap further comprising at least one guiding recess for aligning with corresponding guiding post of the insulative housing.

8. The socket connector as claimed in claim 1, wherein insulative housing can be a plurality of segments, each segment has a plurality of passageways in which a plurality of contact terminals are retained.

9. The socket connector as claimed in claim 8, wherein the side of the contact terminals for connecting with pads of packaged integrated circuit is land grid array (LGA).

10. The socket connector as claimed in claim 9, wherein the orientation of the LGA contact terminals of the adjacent segments are opposite to each other.

11. A method of preventing contact terminals retained in passageways of an insulative housing of a socket connector from being contaminated by particles through openings located on a base plate surface of a pick up cap having a plateaus thereof surrounded by the base plate, comprising the steps of:

(a) aligning guiding recesses on sides of the pick up cap with guiding posts on inner sidewalls of the insulative housing;

(b) holding a pair of raised portions extending upwardly from opposite sides of the plateau and pressing down the pick up cap such that latches extending outwardly from sides of the base plate can attach to slots on outer surface of the perimeter walls of the insulative housing;

(c) attaching a pair of shields to the raised portions for covering the seams.

12. The method as claimed in claim 11, wherein both sides of each shield having a pair of positioning portions for aligning with and attaching to the raised portions.

13. The method as claimed in claim 12, wherein each positioning portion is divided into stopping portion, latching portion and linking portion.

14. The method as claimed in claim 11, wherein the sides of the base plate of the pick up cap further comprising at least one guiding recess for aligning with corresponding guiding post of the insulative housing.

15. The method as claimed in claim 11, wherein the insulative housing comprising a plurality of segments, each segment has a plurality of passageways in which a plurality of contact terminals are retained.

16. The method as claimed in claim 11, wherein the side of the contact terminals for connecting with pads of packaged integrated circuit is land grid array (LGA).

17. The method as claimed in claim 15, wherein the orientations of the contact terminals of the adjacent segments are opposite to each other.

18. An electrical connector comprising:

an insulative housing defining an upwardly facing receiving cavity for receiving an electronic package therein;

a plurality of contacts disposed in the housing with contacting section extending upwardly into the receiving cavity;

a pick up cap mounted upon the housing and defining a relative large suction plane with a pair of raised portions by two sides thereof for manual operation under a condition that a recess formed under each of said raised portions communicates with an exterior laterally and the receiving cavity downwardly; and a pair of shields each being discrete from the pick up cap while blocking the corresponding recess for preventing dust from an exterior into the receiving cavity via said recess.

* * * * *